United States Patent [19]

Labelle

[11] Patent Number: 4,497,412

[45] Date of Patent: Feb. 5, 1985

[54] IMPLEMENT HOLDER

[76] Inventor: Edward J. Labelle, 777 Overlake Dr. E, Bellevue, Wash. 98004

[21] Appl. No.: 588,764

[22] Filed: Mar. 12, 1984

[51] Int. Cl.[3] ..... A47F 5/08; A47F 7/00

[52] U.S. Cl. ..... 211/60 T; 206/350; 211/89; 211/DIG. 1; 248/37.6; 248/309.4; 335/285

[58] Field of Search ..... 211/60 T, 60 R, 89, 211/DIG. 1; 248/37.3, 37.6, 309.4, 206.5, 222.4, 223.1, 223.2; 206/350, 372; 335/285

[56] References Cited

U.S. PATENT DOCUMENTS

| | | | |
|---|---|---|---|
| 2,955,239 | 10/1960 | Rouse | 248/37.6 |
| 3,071,252 | 1/1963 | Hanschar | 211/60 T |
| 3,486,610 | 12/1969 | Hain et al. | 211/60 T X |
| 3,580,394 | 5/1971 | Elliot | 248/37.6 |
| 3,889,809 | 6/1975 | McNair | 211/60 T X |
| 4,294,421 | 10/1981 | Künstlicher et al. | 248/37.6 |

*Primary Examiner*—Robert W. Gibson, Jr.
*Attorney, Agent, or Firm*—Robert W. Jenny

[57] ABSTRACT

The implement holder is intended specifically for knives and a sharpener known as a round sharpening steel and is of the type which is attached to a surface and holds the implements magnetically with the broad surfaces of the knives essentially normal to the mounting surface so that the capacity and safety of the holder are considerably greater for the space required than is possible when the knives are held with their broad surfaces essentially parallel to the mounting surface. The cost of manufacturing the subject holder is low relative to (1) the security of the implement retention, (2) a selected capacity, (3) the quality in terms of aesthetics and the basic materials used and (4) adaptability to various sizes and shapes of knives. The holder may be positioned horizontally and hold the implements vertical or positioned vertically and hold the implements horizontal or at any intermediate angle.

16 Claims, 6 Drawing Figures

IMPLEMENT HOLDER

BACKGROUND OF THE INVENTION

This invention is in the field of apparatus for holding implements which are not in use, specifically, any such apparatus which facilitates quick and simple placement of the implements for holding by the apparatus and quick and simple retreival of the implements for use. More specifically, the invention pertains to holding cutting implements such as knives and to knife sharpening implements, particularly implements made of ferromagnetic materials and holders using magnets to provide or supplement the holding forces. Further, the invention is in the field of implement holders which are fastened to a surface for use and which hold knives and the like vertically, horizontally or flat in a space such as a drawer with their cutting edges positioned toward the surface because such positioning reduces the chances for injuries during placement or removal of the knives and by inadvertant contact with held knives.

Holders of this type need not require any more storage or access space than is needed for the implements themselves because the implements are placed for holding or removed by moving the implements directly toward the mounting surface and into the holding position or away from it and out of the holding position respectively. This is not true for holders such as slotted blocks and the like which require endwise motion of the implements for placement in and removal from the block and extra access space is needed for such motion for placement and removal. The field includes apparatus which can accept implements of variable proportions in terms of total length and the ratio of handle length to total length.

There is a variety of prior art apparatus incorporating the noted features of apparatus in the subject field. U.S. Pat. No. 2,357,646 covers a knife holder in which the knives are placed vertically with their cutting edges toward a mounting surface. The ends of the handles of the knives rest in recesses in a ledge and the blades are retained in corresponding slots in a second ledge by spring loaded balls. The utility of this apparatus is limited because the knife ends and recesses must match to a certain extent and the distance between the ledges allows accomodation only of knives having proportions in limited ranges of handle and knife lengths. Also, while the spring loaded balls may satisfactorily restrain blades having parallel sides, they would tend to expel blades which taper from the sharp edge to a broader back edge or blades which have multiple bevels or are tapered.

FIGS. 5, 6 and 7 of U.S. Pat. No. 2,955,239 illustrate apparatus for holding knives in slots with the sharp edges facing into the slots. Magnet assemblies are positioned in pockets, one on each side of each slot. The magnet assemblies for each slot are positioned opposite each other and are of similar polarity, thereby repelling each other and thereby being held bottomed in their respective pockets when there is no knife in the slot. When a knife blade of magnetic material is inserted into a slot, the magnets cease to repel each other and are attracted to the blade, serving to hold it in place by the frictional force between the blade and the magnets. In this apparatus two magnets are required for each slot. Also, while housing or base 112 is illustrated as a single piece, installation of the magnets would in fact require that it be made with a multiplicity of parts.

Details of assembly in some manner could be established by persons of ordinary skill in the art. However, it is evident, since the patented apparatus is not known to have achieved commercial success, that inventive capabilities would be required to enable manufacture of the apparatus at a competitive cost. Also, experience indicates that the flat circular surfaces of the magnets would not adapt to all the various blade shapes sufficiently to assure secure holding of many of the various kinds of commercially available knives.

U.S. Pat. No. 3,580,394 also shows apparatus in the particular field of the subject invention. The primary force holding the knife or the like in the slot is the friction force developed between one wall of the slot, the knife blade and a roller which rolls on the other side of the slot, this other side being inclined downwardly and toward the first side so that gravity and friction forces generated by applying downward forces on the knife cause the roller to wedge the knife in place. Stop means are provided to prevent the roller itself from wedging into place with no knife in the slot. This patent further suggests the expensive option that the body of the holder could be made of ferromagnetic material and magnetized to supplement the holding action on ferromagnetic implements. A further suggestion is to encapsulate a magnet alongside the slot in a holder made of non-ferromagnetic material to augment the holding action. Placement of a knife in this holder required some lengthwise motion of the knife. Therefore this holder required more space than is needed when the knives can be inserted using only motion normal to the surface on which the holder is mounted.

This patented holder is intended to be made of any of a variety of materials depending on "... the production facilities available, the economics to be effected, and/or the aesthetic results to be obtained." Even so, it is not known to have achieved commercial success and therefore it can be concluded that the concept has not enabled marketing a holder offering a suitably attractive combination of quality, utility, aesthetic appearance and cost.

International application WO No. 79/00376 published under the Patent Cooperation Treaty also shows apparatus in the particular field of the subject invention. In this apparatus knives or the like are held in slots by mated sets of wheels with elastomeric rims, with the sharp edges of the knives facing into the slots. In such apparatus there is a tendency for knife blades which are wedge shaped in cross-section to be expelled from between the rollers. Further, in order to have sufficient contact areas between the knives and rollers, using relatively firm elastomer for stability and durability, the roller diameter must be relatively large. Therefore, with two rollers and some clearance space between knives, the space between knives is fairly large and the number of knives held in a given length of holder is accordingly fairly low.

Other prior art in the particular field has been shown in various publications. For example, advertisements show a wall mounted holder for the blades and handle of the General Electric Spacemaker TM Electric Knife, EK30. This holder is designed to specifically hold the blades and handle of the electric knife and relies on gravity to hold the elements in place in recesses. One such advertisement was published on page 48 of Volume 9, Number 27 of Family Circle magazine. In this same issue, on page 28, there is an illustration and description of a holder for knives and a sharpening tool in a drawer. The holder fits crosswise in the bottom of the drawer and has a series of wedges cut into it parallel to the open-shut direction of the drawer. Each wedge shaped cut accepts one knife and one wedge cut is designed to hold a sharpening tool. Experience has shown that unless the holder is fixed in place in the drawer and endwise motion of the knives or sharpener is limited, the implements are easily dislodged by the open/shut motion of the drawer. Further, this holder is restricted to use in a drawer or on a counter, in each case using up quite a large area of otherwise useful space. The holder is noted in this publication along with other aesthetically pleasing subjects.

It should be noted that there is a variety of prior art in a more general field in which knives are held magnetically with one of the broad surfaces of each blade against immovable magnetic means. Holders of this type have the basic disadvantages of (1) requiring more space than those which hold the broad surfaces of the knives parallel to each other and normal to the mounting surface of the holder and (2) the blades can be accidentally knocked, jarred, vibrated or otherwise moved directly away from the magnetic apparatus, thus making it relatively easy to dislodge the knives accidentally, with attendant hazards. This is caused primarily by the fact that once the knife is out of contact with either pole piece of a magnetic assembly, the force tending to hold the knife in place diminishes rapidly so that even a small and momentary disturbance of the knife can cause it to come free of the holder. A further disadvantage of the immovable magnet type holder is that it is not useful in instances in which space available could be more efficiently used if the holder is vertical on a vertical wall and the held implements oriented horizontally.

The subject invention, to be useful in either a vertical or horizontal orientation and require minimum space, incorporates magnets in a special way described later in this application. The magnets are a type quite well represented in the prior art and comprise a magnetized element, sandwiched between two faceplates which function as pole pieces. The faceplates have edges and the edges contact whatever is to be magnetically held. The faceplates are free to slide on the magentized element to conform to and/or align with whatever is magnetically held to enhance the holding capacity. In some instances, as shown in U.S. Pat. No. 2,877,040, the faceplates are attached to each other and move in unison laterally and rotationally about a support pin. The example in U.S. Pat. No. 3,163,453 allows only for rotary motion of the magnetic assembly around the support pin.

The magnetic assembly shown in FIGS. 6 and 7 of U.S. Pat. No. 3,235,302 has virtually 4 degrees of freedom within the limits of the space provided by the bracket which contains it. However, the two faceplates are fastened to the magnetic core and do not move relative to each other.

In the examples shown in U.S. Pat. Nos. 3,174,786 and 3,438,655 the faceplates move in parallel planes and the motions are constrained to be essentially equal and opposite by "whiffletree" type mechanism. The magnetic assembly fits loosely in the main housing in a way which permits rotational displacement of the assembly relative to the housing as shown in FIG. 6. As shown in these patents these arrangements allow the magnetic assembly to adjust with two degrees of freedom to angular misalignment between the magnetic assembly and whatever apparatus it is designed to magnetically hold to.

It can be seen from the above discussion that there have been attempts to satisfy the long standing need for safe, economical, compact and aesthetically attractive storage apparatus for knives and the like. It is also evident that magnets and magnetic assemblies have been considered useful in such apparatus and that the magnetic assemblies are (1) similar to or adapted from magnetic latches and the like and (2) have the capability for their working faces to adjust to some degree for misalignments and/or irregularities of the surfaces of the objects which are to be held magnetically.

It is further evident, from market survey and literature research, that none of the prior attempts to meet the need has been commercially successful Therefore, to summarize, it is the object of the subject invention to meet the need for a holder for implements such as knives and the like which can be manufactured for costs which are low relative to (1) the selected capacity, (2) the safety in terms of the security of retention of the implements, (3) the quality in terms of the basic material used and the aesthetic appearance, (4) optimal adaptability to various sizes and shapes of knives and (5) the space required to place, hold and retreive the implements. It is a further ojbect that the holding apparatus not mar in any way finely finished surfaces of held objects.

SUMMARY OF THE INVENTION

The subject invention is a holder for knives and the like and knife sharpening tools, all of ferromagnetic material. It comprises an elongated body of essentially rectangular cross-section. The body is to be mounted against a surface such as a wall, a counter top or drawer bottom. When it is mounted on an essentially vertical surface, such as a wall, it can be oriented with its long dimension horizontal or vertical or at any angle between the two. There is a plurality of slots in the body, essentially evenly spaced along its length. The slots are at right angles to the long dimension of the body and the bottoms of the slots are essentially parallel to the mounting face of the body. There is a magnetic apparatus associated with each slot. Each apparatus is free to move normal to the adjacent slot (i.e. in the direction parallel to the long axis of the body), the range of the motion being such that at one extreme the apparatus is protruding slightly into the slot and, at the other extreme, leaves the slot fully open. In operation, and using a knife as a first example, the knife is inserted sharp edge first into a slot. In other words, the knife is positioned sharp edge facing the bottom of the slot and, accordingly, the surface on which the holder is mounted. If the magnetic apparatuses protruding into the slot before the knife is put into the slot, the sharp edge of the knife well easily fit between it and the wall of the slot opposite the magnetic apparatus. If the slot is essentially open when the knife is placed in the slot, it and the magnetic apparatus immediately are brought into contact by the magnetic forces. Once the knife is in place, by virtue of the dimensions of the slot and the freedom of the magnet apparatus to move essentially in a direction normal to the slot, the knife can not be pulled, jarred, shocked, vibrated, or otherwise taken out of contact with the magnet except by sliding the knife across the magnetic apparatus. Because there is some clearance around the magnetic apparatus, it is free to adjust its position angularly to some extent to further aid its maintaining contact with the knife in a slot. This capability is further supplemented by the free relative motion of the parts of the magnetic apparatus, within limits. Removing a knife in this fashion requires a relatively prolonged application of force over a relatively significant distance. This fact greatly reduces chances of accidental dislodging of knives from the subject holder.

Using a knife sharpening tool as a second example, the operating principles are much the same. However, the slot is necessarily wide enough to accept the tool. There is sufficient possible movement of the magnetic apparatus so that, once the tool is in place and in contact with the magnetic apparatus, it cannot be moved directly out of contact with the magnetic apparatus but must be slid out of contact with it.

When the holder is installed it has the appearance of being one piece, such as of wood. No fastenings are visible. Articles are held securely according to the functional principles described. A relatively large number of articles can be stored within a given space. No space is needed for endwise motion of the knives or sharpener relative to the holder for the purposes of inserting or removing articles and, as will be evident to those skilled in the art from the drawings and detailed description of the invention, it can be economically manufactured. Further, this holder is unique among magnetically augmented holders in that is can be mounted vertically with the implements held horizontally or at any angle between horizontal and vertical. In fact, the implements are most securely held with the holder mounted vertically. Further, the selection of materials and/or the material of coatings used is such that there is no chance of marring any finely finished surfaces of the held articles.

DETAILED DESCRIPTION OF THE INVENTION

Figure 1A:
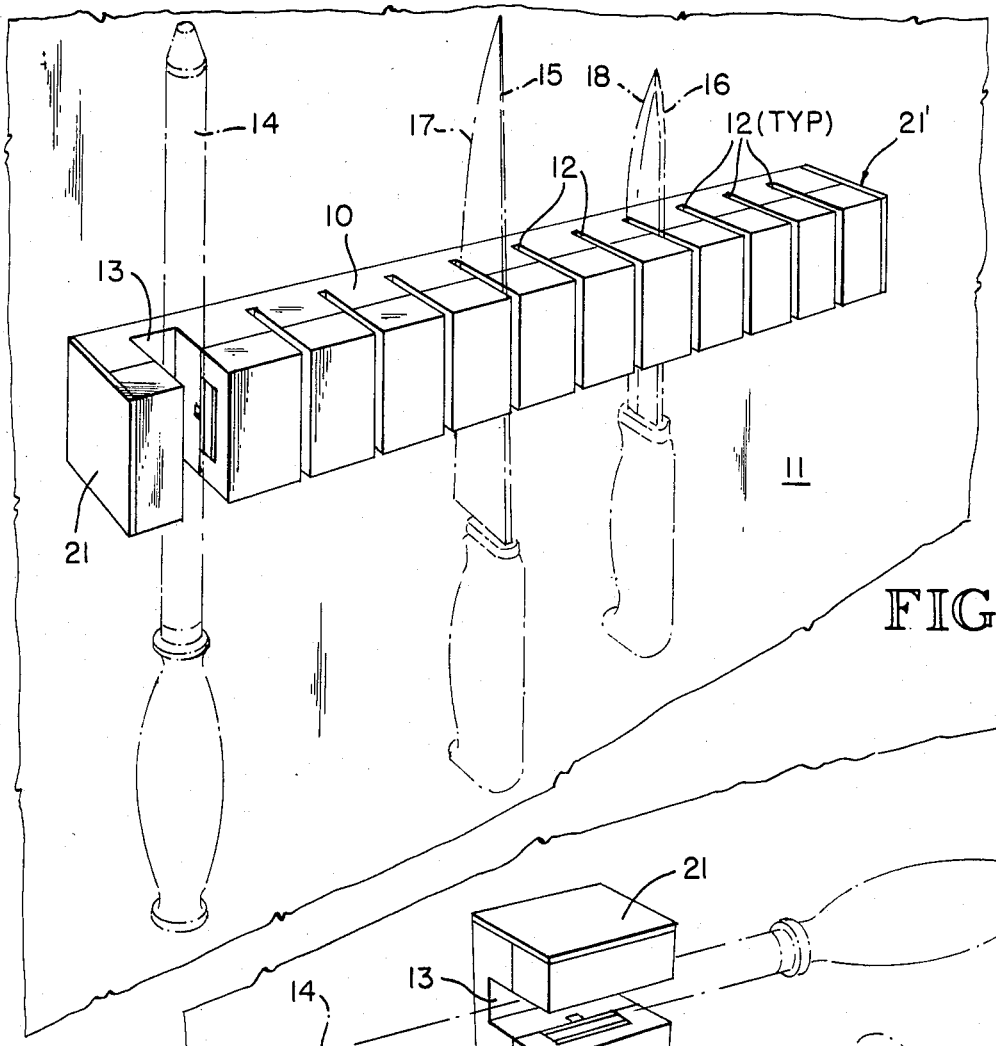
FIG. 1A, is a perspective view of the subject implement holder mounted horizontally on a vertical surface and in use.
Figure 1B:
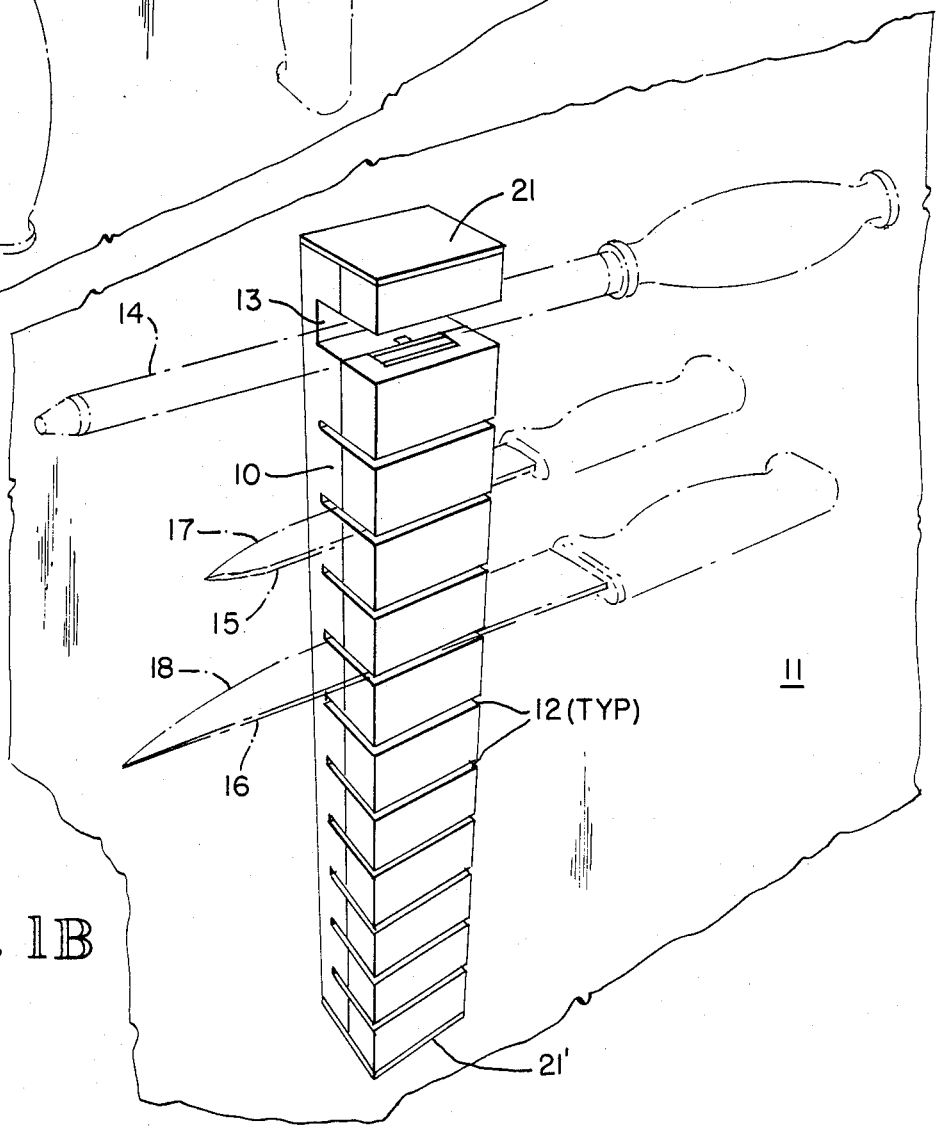
FIG. 1B, illustrates the holder mounted vertically on a vertical surface and in use.

Referring to FIG. 1, the subject holder comprises a body 10 attached to surface 11 by means described later. There is a plurality of slots 12 in the body, each able to accept a knife or the like for storage. In FIG. 1A, the body is mounted with its long dimension essentially horizontal and, in FIG. 1B, with its long dimension essentially vertical and, as shown, the slots are essentially vertical for horizontal mounting, horizontal for vertical mounting and normal to the mounting surface. Slot 13 is wider than the other slots in order to be able to accept and hold a knife sharpening tool. Tool 14 and knives 15 and 16 are shown in place for storage. The sharp edges 17 and 18 respectively of the knives face into the slots so that there is minimum chance of accidental contact between the sharp edges and parts of the human body or other objects which might be harmed by such accidental contact.

The space between slots and items held in them is determined to be sufficient to allow easy, safe access to the handle of each knife or the like held but also such that the number of knives or the like is relatively large for the length of the holder. As explained in more detail later, there is magnetic apparatus associated with each slot to provide secure retention of all stored items.

The body 10 is made from two parts, 19 and 20 (FIG. 2), and two end caps 21 and 21' (FIG. 1). In a preferred embodiment all the parts are made of wood and assembled so that the body, for aesthetic purposes, appears to be essentially a single piece of wood. This same effect is readily achievable with other materials as well, such as various plastics. The parts are attached to each other by any of a variety of fastening means including adhesives, all well known in the art. Parts 19 and 20 are adhesively attached before the slots are cut and are shown in FIG. 2 just prior to adhesive attachment.

As shown, part 19 is channel shaped to provide space for the magnetic apparatus associated with each slot, channel 23 running from end to end of the part, centered in it laterally and forming a cavity for the magnetic apparatus. The slots 12 and 13 (FIG. 1) are cut through part 19 and into part 20 after the parts are adhesively attached and part 19 obviously becomes a plurality of parts after the slots are cut.

Part 20, a rectangular solid, has a groove 22 along the longitudinal centerline of its face 24A for reasons explained later. Also, specially contoured holes 25 and 25' are positioned one near each end of part 20, a distance X apart and are for the purpose of attaching the holder to the surface on which it is mounted.

Figure 2:
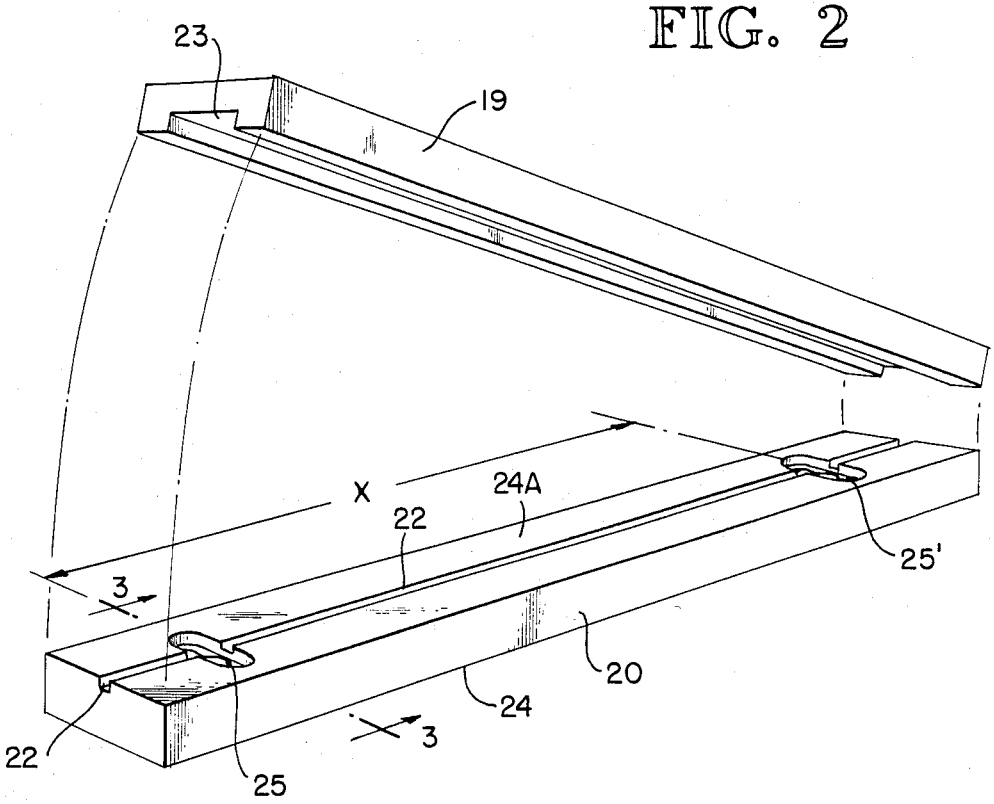
FIG. 2 Is an exploded, perspective view of the two components, a preferred implementation of the body of the holder before assembly and before the slots for the implements have been made.
Figure 3:
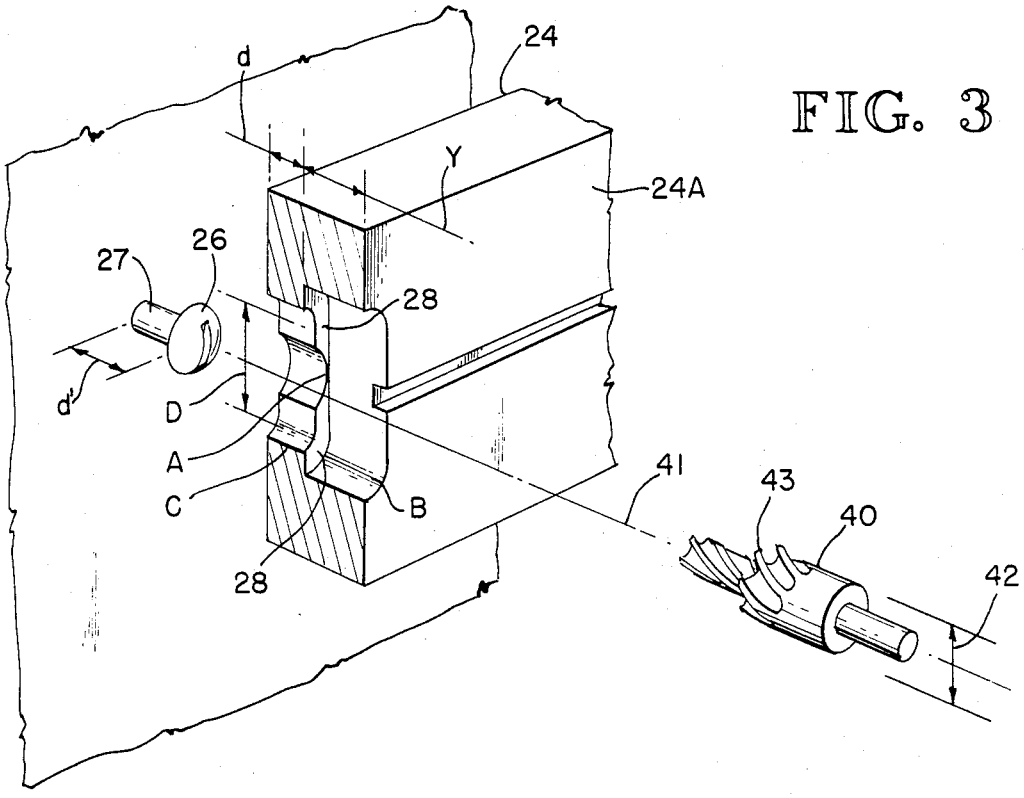
FIG. 3 Is a sectional view showing the details of the slots used for retaining the holder in place against the mounting surface, including the nature of the tool and techniques used in making the slots.

The details of holes 25 and 25' are shown in FIG. 3 which is a sectional view of 3—3 in FIG. 2. This is a type of hole generally well known in the art for blind fastening of articles such as picture frames and the like to walls for example, and is known as a "keyhole" after the well known shape of the holes for old fashioned keys. The subject holes are, in fact, "double ended" keyholes and comprise three parts: hole A which is large enough for the head of an attachment screw 26 to pass through; elongated cavity B in which the inserted head can be moved to either end of the cavity and slot C which is large enough to allow the shank 27 of screw 26 to move from end to end, such as distance D which is the long dimension of the double ended keyslot.

For installation of the holder, screws 26, one for each of holes 25 and 25', are fastened into the mounting surface, using an appropriate means well known in the art, with the undersides of their heads out from the surface a distance d' slightly greater than dimension d, the distance of cavity B from the mounting face 24 of part 20. Obviously, the screws are spaced apart a distance equal to the distance between holes 25 and 25'. The holder is then moved so that the heads of the screws pass through hole A and into cavity B and the mounting face 24 of part 20 is against the mounting surface. The holder is then moved downward, or sideward for the vertical mounting position, in contact with the mounting surface so that the heads engage working surface 28 of cavities B, thus retaining the holder against the mounting surface. It is clear that a single-ended keyhole would serve the purpose thus far described. The purpose for using a double keyhole is to allow switching the position of the holder end for end on the same two mounting screws. This, in effect, provides left hand or right hand mounting of the holder. This alternative is a convenience, not a necessity, and has been found to be convenient because of the action produced by the fact that the magnetic apparatus associated with each slot operates from one side only of each slot.

A preferred material for the subject holder is wood and holes 25 and 25' must be made by machining them. There are tool kits manufactured specifically for machining holes and slots such as 25 and 25', such as item 6700, Keyhole Router Bit, shown on page 47 of the Winter 1983 Catolog published by Leichtung, "The Workbench People", 4944 Commerce Parkway, Cleveland, Ohio, 44218. However, experience has shown that such bits must be used with great care to be sure the chips are constantly cleared and not allowed to clog up. Otherwise, since these bits are used at high speeds such as 20,000 RPM, the tool can seize up instantaneously and cause the tool and/or part to disintegrate, presenting serious hazards to the operators. Therefore, in the subject invention, holes 25 and 25' are machined with a more conventional bit 40, shown in FIG. 3, before parts 19 and 20 are adhesively assembled and the keyhole can be made without the need for a T-slot cutter. To machine each hole the stepped cutter is advanced through part 20 moving along centerline 41 from the "inside" surface 24A of part 20 through to and beyond the outside or mounting face 24 so that the larger diameter 42 of bit 40 machines a hole completely through part 20. Then the cutter bit is positioned so that end 43 of the larger diameter section is at depth Y in the hole and the bit is then moved up (in the illustration) a distance D/2 and down distance D. This completes the machining of the hole and the tool is removed.

Figure 4:
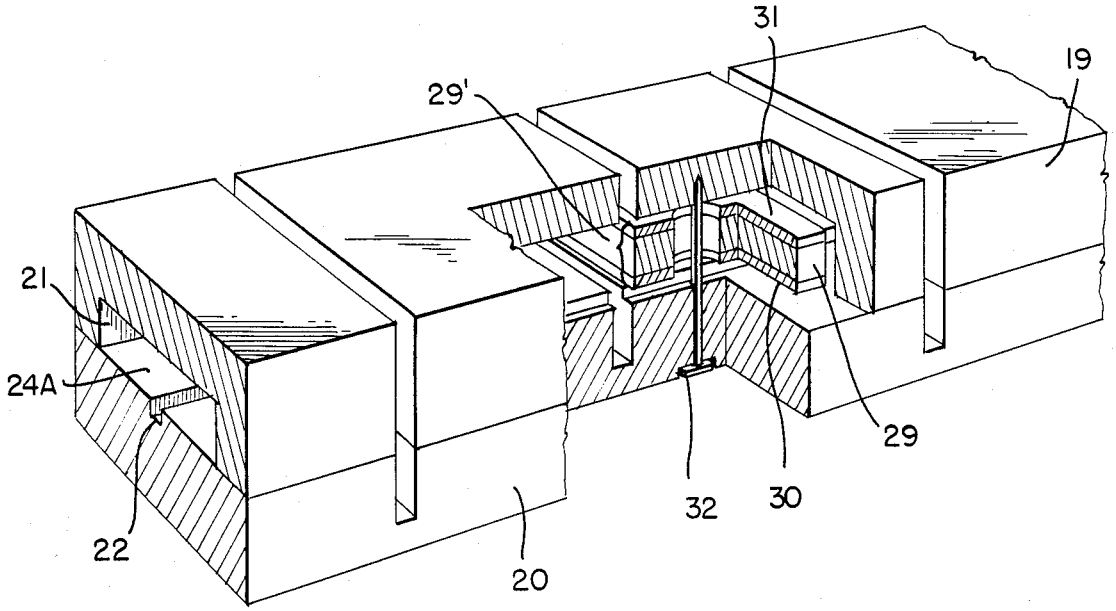
FIG. 4 Is a sectional, perspective view of the holder showing the details of the magnetic apparatus associated with each slot and its positional relationship with the slot.
Figure 5:
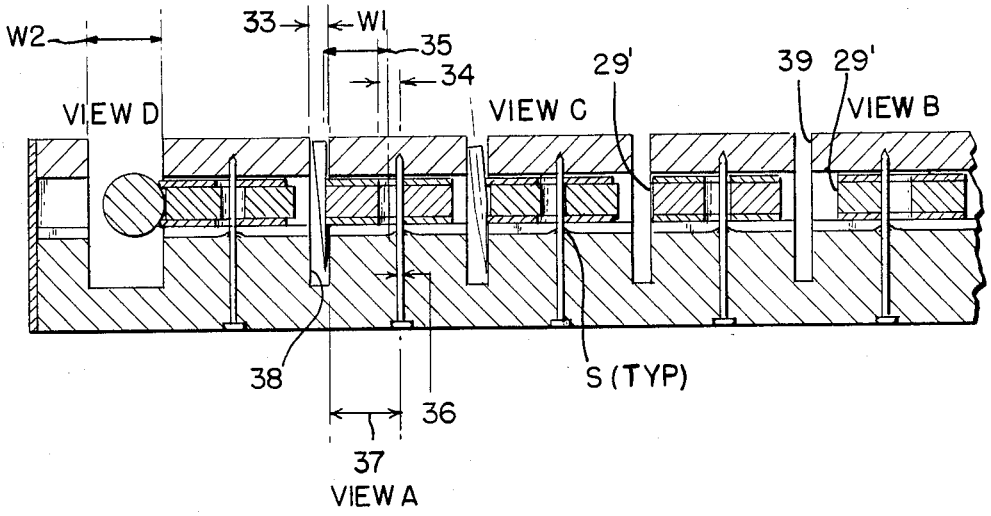
FIG. 5 Is a sectional view of portions of the holder further illustrating the positioning and operation of the magnetic apparatus associated with each slot.

The magnetic apparatus is illustrated in FIGS. 4 and 5. Referring to FIG. 4, each apparatus comprises (1) a flat rectangular permanent magnet 29 magnetized so that its two largest flat surfaces are of opposite polarity and (2) two relatively thin face plates, 30 and 31, which serve as pole pieces to concentrate the magnetic flux of the magnet at their thin edges. The three pieces have essentially the same flat plate shape and size and equal sized holes at their geometric centers. The apparatus as described is widely used in the industry for a variety of purposes and is accordingly available at cost made low by virtue of the large production.

Each magnetic apparatus is installed next to its associated slot 12 by positioning it in channel 23 near its slot and retaining it by driving "T-brad" 32 through part 20, the holes in the magnetic apparatus and into part 19. The apparatus fits loosely in channel 23 but is confined sufficiently so that it cannot rotate around the brad more than approximately 10° in either direction. When such brads are driven through wood, quite often small splinters of wood are pushed out around the brad where it exits a penetrated part. The presence of such splinters between the brad and the bores of the holes in the magnetic apparatus would interfere with the functions of the apparatus which are described later. Groove 22 in face 24A of part 20 eliminates any problems which could be caused by the splinters because the splinters, if any, are generated at the bottom of the groove and do not interfere with the magnetic apparatus. See splinters S in FIG. 5.

The functions of the magnetic apparatus for all slots 12 are described with reference to FIG. 5. Several dimensions inter-relate to contribute to the proper function of the apparatus. The dimensions include the width 33 of the slot, the diameter 34 of the holes in the apparatus, the distance 35 of the centers of the holes to the edges of the apparatus parts, the diameter 36 of the brad and the distance 37 of the centerline of the brad from the nearest side of the associated slot.

In particular the longitudinal location of each magnetic apparatus relative to each associated slot is determined by (1) the distance between the working face 29' of the magnetic apparatus and the portion of the center hole farthest from the face of the slot nearest the magnetic apparatus and (2) the distance of the portion of the outer surface of the T-brad farthest from the same face of the slot. The interrelation of these dimensions is such that the working face of the apparatus, at one extreme of its motion along channel 23, as shown in View A of FIG. 5, protrudes slightly into the slot. The distance of the protrusion is in the range of 0.010 to 0.030 inches. It is also such that at the other extreme of its motion along channel 23, as shown in View B of FIG. 5, the working face of the apparatus is withdrawn past surface 39 of the slot, the surface nearest the apparatus.

It is well within the capability of people of ordinary skill in the art to establish the noted dimensions and the inter-relationships once a slot width 33 is selected. Widths in the range of 0.125 to 0.140 inches have been found to be adequate to accept a wide variety of knives and the like and the slot width is designated W1 in FIG. 5.

The purposes achieved by these interrelationships are as follows. First, if the apparatus is positioned as shown in View A, a knife can be readily inserted by placing its sharp edge on surface 38 and moving it into the slot, displacing the magnetic apparatus if necessary. Contact between the knife and the apparatus is obviously assured. This technique of placing the knife blade against a particular face of the slot is the characteristic which is the basis for preference for left hand or right hand installation of the holder.

Second, if the apparatus is positioned as shown in View B and a knife is inserted in the slot, there is ample clearance for the knife and the magnetic apparatus rapidly moves to contact and hold the knife.

Third, once the knife or the like, is in the slot and in contact with the magnetic apparatus, it is not possible to move the knife out of the hold of the magnetic apparatus except by sliding it past the apparatus for a distance at least equal to the width of the knife blade or the width of the apparatus, whichever is least. In either case, it is necessary that accidental jarring, contact, etc. must provide substantial force over substantial distance to dislodge a stored knife. This is clearly not the case with the well known, commercially available, immovable magnet holders which hold the knife blades broadside against magnetic means. With such holders, experience has shown that accidental jarring, contact, etc. can easily move the knife blade directly out of contact with one or both poles of the magnetic means so that chances for accidental dislodgement of stored knives can be considered higher than desireable.

Fourth, as shown in View C of FIG. 5, the allowable relative motion between the parts of the magnetic apparatus assures that the face plates (pole pieces) can make firm contact with knives having any of a wide variety of blade cross-sectional shapes. Also, the forces holding the knife do not in any way tend to expel the knife from the holder.

No marring of finely finished surfaces of the held implements which might be caused by the relative motion between the implements and magnetic means during insertion and removal is possible because the magnetic parts are either made of plastic material or coated with plastic material which is not hard enough to mar steel. A suitable coating material is Teflon, a Dupont product. Suitable materials made magnetic by filling with particles of magnetic materials are well known in the art, barrium ferrite in a thermoplastic binder as marketed by Adams Magnetic Products being a good example.

In regard to slot 13 for holding the knife sharpening tool, the interrelated dimensions include the diameter of the tool since it was found to be not practical to provide magnetic apparatus which could effectively bridge a slot wide enough to accept a conventional knife sharpening tool. A suitable slot width (W2 in FIG. 5) for the sharpening tool, known as a round sharpening steel, has been found to be 11/16 of an inch. This width accepts the larger tools found to be commercially available and also allows the magnetic assembly to attach to the smaller available tools. This means that it is difficult to move the tool directly away from the magnetic apparatus. Usually it must be twisted or slid out of engagement, requiring a greater force/distance combination to accidentally dislodge the tool than is likely to occur except under rare circumstances. View D of FIG. 5 is a sectional view of a knife sharpener placed in slot 13 and illustrates how the allowed relative motion between the 3 parts of the magnetic apparatus permits the two pole pieces to come into contact with the cylindrial shape of the sharpener for line contact between each piece and the sharpener instead of the point contacts provided in the conventional wall mounted holders typified by the holders shown in U.S. Pat. Nos. 3,842,980 and 3,827,021. The line contact by both pole pieces adds to the holding security provided by the fact that the sharpener cannot be moved directly away from the pole pieces.

The assembly of the holder is completed by the attachment of end pieces 21 and 21'. This is done with adhesives with the preferred material being wood. The completed assembly is then finished using techniques well known in the art for providing quality finishes on wooden articles.

It has been found that the completed holder can be easily kept clean of such substances as might be deposited on it or in it if knives are stored before being cleaned. This is not the case when knives are stored in the commercially available slotted blocks of wood used for storing knives.

It can be understood from this description that the subject invention meets the expressed objectives. It is an aesthetically pleasing holder able to securely hold a relatively large number of knives and a knife sharpener in little more space than that needed for the knives and the space needed around each one for grasping its handle. The design is adapted for economical manufacture, incorporating such features as (1) the use of magnetic apparatus manufactured in large quantities for other purposes, (2) the slot for accepting the splinters produced by driving the brads, (3) the use of the automatically driven T-brads and (4) the machining of holes 25 and 25' with a conventional stepped diameter router bit.

A preferred embodiment of the subject invention is described herein and some variations mentioned. It is understandable that other implementations and variations will occur to those familiar in the art which will fall within the scope of the subject invention as set forth by the appended claims.

What is claimed is:

1. A holder for knives and the like to be mounted on a mounting surface and comprising:

a body having a first end, a second end, a long dimension extending from said first end to said second end, a mounting face, a cavity having a cross section and extending from said first end to said second end and at least one slot oriented essentially perpendicular to said mounting face and said long dimension, said at least one slot having a width and a first face and extending part way through said body toward said mounting face and intersecting said cavity, said body being mountable with said mounting face against said mounting surface;

means for attaching said body to said mounting surface with said mounting face against said mounting surface;

at least one fastener having an outer surface having a portion farthest from said at least one slot;

at least one magnetic means sized to fit in said cross section of said cavity, having a working face, a center, a hole through said center, said hole having a diameter and a wall with a portion of said wall farthest from said working face and a distance between said working face and said portion of said wall farthest from said working face and said at least one magnetic means positioned in said cavity with said working face essentially coplanar with said first face of said at least one slot and being retained in said at least one slot and being retained in said cavity by said at least one fastener inserted into said body perpendicular to said mounting face extending through said hole and said cavity; whereby, with said body attached against said mounting surface by said means for attaching with said mounting face against said mounting surface, a knife or the like of ferromagnetic material inserted into said at least one slot is engaged by said at least one magnetic means and thereby held.

2. The holder of claim 1 in which said portion of said outer surface of said at least one fastener is disposed away from said first face of said at least one slot by a distance slightly less than said distance between said working face of said at least one magnetic means and said wall farthest from said working face, whereby said working face of said at least one magnetic means extends into said at least one slot an amount in the range of 0.010 to 0.030 inches.

3. The holder of claim 1 in which said means for attaching said body to said mounting surface with said mounting face against said mounting surface comprises:

a first keyhole shaped T-slot hole in said mounting face near said first end of said body, a second keyhole shaped T slot in said mounting face near said second end of said body, said keyhole shaped T-slots each having a hole portion and a lengthwise dimension, said lengthwise dimensions being oriented perpendicular to said long dimension of said body, said first keyhole shaped T slot being a distance X from said second keyhole shaped T slot, said T slots having working surfaces a distance d from and being parallel to said mounting face, a first fastener having a head and an underside of said head;

a second fastener having a head and an underside of said head, whereby, with said first fastener inserted into said mounting surface with said underside of said head a distance slightly greater than said distance d from said mounting surface and second fastener inserted into said mounting surface a distance X from said first fastener and with said underside of said head of said second fastener a distance slightly greater than said distance d from said mounting surface, said body is attached to said mounting surface by moving said hole portions of said keyhole shaped T slots over said first and second fasteners until said mounting face contacts said mounting surface and then moving said body parallel to said long dimensions of said T slots so that said undersides of said first and second fasteners engage said working surfaces of said first and second T slots.

4. The holder of claim 1 in which said body has at least one first slot having width W1 and at least one second slot having width W2, said at least one first and at least one second slots each being oriented essentially perpendicular to said mounting face and said long dimension and having a first face, a second face and extending part way through said body toward said mounting face and intersecting said cavity, said width W1 being suitable for holding knives and the like and said width W2 being suitable for holding a knife sharpener and the like.

5. The holder of claim 1 in which said cavity has a rectangular cross-section having one face closest to and essentially parallel to said mounting face, said one face having a longitudinal center line parallel to said long dimension of said body, said cavity further having a groove in said one face centered on and parallel to said center line.

6. The holder of claim 1 in which said cavity extends through said body from said first end to said second end parallel to said long dimension and is open at said first end and said second end, and a first cap is attached to said first end to close off said cavity at said first end and a second cap is attached to said second end to close off said cavity at said second end.

7. The holder of claim 1 in which said portion of said outer surface of said at least one fastener is disposed away from said first face of said at least one slot by a distance slightly less than said distance between said working face of said at least one magnetic means and said portion of said wall farthest from said working face, whereby said working face of said at least one magnetic means extends into said at least one slot an amount in the range of 0.010 to 0.030 inches, and in which said means for attaching said body to said mounting surface with said mounting face against said mounting surface comprises:

a first keyhole shaped T slot hole in said mounting face near said first end of said body, a second keyhole shaped T slot in said mounting face near said second end of said body, said keyhole shaped T slots each having a hole portion and a lengthwise dimension, said lengthwise dimensions being oriented perpendicular to said long dimension of said body, said first keyhole shaped T slot being a distance X from said second keyholes shaped T slot said T slots having working surfaces a distance d from and being parallel to said mounting face, a first fastener having a head and an underside of said head, a second fastener, having a head and an underside of said head, whereby, with said first fastener inserted into said mounting surface with said underside of said head a distance slightly greater than said distance d from said mounting surface and said second fastener inserted into said mounting surface a distance X from said first fastener and with said underside of said head of said second fastener a distance slightly greater than said distance d from said mounting surface, said body is attached to said mounting surface by moving said hole portions of said keyhole shaped T slots over said first and second fasteners until said mounting face contacts said mounting surface and then moving said body parallel to said long dimensions of said T slots so that said undersides of said first and second T slots.

8. The holder of claim 1 in which said portion of said outer surface of said at least one fastener is disposed away from said first face of said at least one slot by a distance slightly less than said distance between said working face of said at least one magnetic means and said portion of said wall farthest from said working face, whereby said working face of said at least one magnetic means extends into said at least one slot an amount in the range of 0.010 to 0.030 inches and in which said body has at least one first slot having width W1 and at least one second slot having width W2, said at least one first and at least one second slots each being oriented essentially perpendicular to said mounting face and said long dimension and having a first face, a second face and extending part way through said body toward said mounting face and intersecting said cavity, said width W1 being suitable for holding knives and the like and said width W2 being suitable for holding a knife sharpener and the like.

9. The holder of claim 1 in which said portion of said outer surface of said at least one fastener is disposed away from said first face of said at least one slot by a distance slightly less than said distance between said working face of said at least one magnetic means and said portion of said wall farthest from said working face, whereby said working face of said at least one magnetic means extends into said at least one slot an amount in the range of 0.010 to 0.030 inches, and in which said cavity has a rectangular cross section having one face closest to and essentially parallel to said mounting face, said one face having a longitudinal center line parallel to said long dimension of said body, said cavity further having a groove in said one face centered on and parallel to said center line.

10. The holder of claim 1 in which said portion of said outer surface of said at least one fastener is disposed away from said first face of said at least one slot by a distance slightly less than said distance between said working face of said at least one magnetic means and said portion of said wall farthest from said working face, whereby said working face of said at least one magnetic means extends into said at least one slot an amount in the range of 0.010 to 0.030 inches, and in which said cavity extends through said body from said first end to said second end parallel to said long dimension and is open at said first end and said second end, and a first cap is attached to said first end and a second cap is attached to said second end to close off said cavity at said second end.

11. The holder of claim 1 in which said portion of said outer surface of said at least one fastener is disposed away from said first face of said at least one slot by a distance slightly less than said distance between said working face of said at least one magnetic means and said portion of said wall farthest from said working face, whereby said working face of said at least one magnetic means extends into said at least one slot an amount in the range of 0.010 to 0.030 inches, and in which said means for attaching said body to said mounting surface with said mounting face against said mounting surface comprises:

a first keyhole shaped T slot hole in said mounting face near said first end of said body, a second keyhole shaped T slot in said mounting face near said second end of said body, said keyhole shaped T slots each having a hole portion and a lengthwise dimension, said lengthwise dimensions being oriented perpendicular to said long dimension of said body, said first keyhole shaped T slot being a distance X from said second keyhole shaped T slot said T slots having working surfaces a distance d from and being parallel to said mounting face, a first fastener having a head and an underside of said head, a second fastener having a head and an underside of said head, whereby, with said first fastener inserted into said mounting surface with said underside of said head a distance slightly greater than said distance d from said mounting surface and said second fastener inserted into said mounting surface a distance X from said first fastener and with said underside of said head of said second fastener a distance slightly greater than said distance d from said mounting surface, said body is attached to said mounting surface by moving said hole portions of said keyhole shaped T slots over said first and second fasteners until said mounting face contacts said mounting surface and then moving said body parallel to said long dimensions of said T slots so that said undersides of said first and second fasteners engage said working surfaces of said first and second T slots, and also in which said body has at least one first slot having width W1 and at least one second slot having width W2, said at least one first and at least one second slots each being oriented essentially perpendicular to said mounting face and said long dimension and having a first face, a second face and extending part way through said body toward said mounting face and intersecting said cavity, said width W1 being suitable for holding knives and the like and said width W2 being suitable for holding a knife sharpener and the like.

12. The holder of claim 1 in which said portion of said outer surface of said at least one fastener is disposed away from said first face of said at least one slot by a distance slightly less than said distance between said working face of said at least one magnetic means and said portion of said wall farthest from said working face, whereby said working face of said at least one magnetic means extends into said at least one slot an amount in the range of 0.010 to 0.030 inches, and in which said means for attaching said body to said mounting surface with said mounting face against said mounting surface comprises:

a first keyhole shaped T slot hole in said mounting face near said first end of said body, a second keyhole shaped T slot in said mounting face near said second end of said body, said keyhole shaped T slots each having a hole portion and a lengthwise dimension, said lengthwise dimensions being oriented perpendicular to said long dimension of said body, said first keyhole shaped T slot being a distance X from said second keyhole shaped T slot, said T slots having working surfaces a distance d from and being parallel to said mounting face, a first fastener having a head and an underside of said head, a second fastener, having a head and an underside of said head, whereby, with said first fastener inserted into said mounting surface with said underside of said head a distance slightly greater than said distance d from said mounting surface and said second fastener inserted into said mounting surface a distance X from said first fastener and with said underside of said head of said second fastener a distance slightly greater than said distance d from said mounting surface, said body is attached to said mounting surface by moving said hole portions of said keyhole shaped T slots over said first and second fasteners until said mounting face contacts said mounting surface and then moving said body parallel to said long dimensions of said T slots so that said undersides of said first and second fasteners engage said working surfaces of said first and second T slots and also in which said cavity has a rectangular cross-section having one face closest to and essentially parallel to said mounting face, said one face having a longitudinal center line parallel to said long dimension of said body, said cavity further having a groove in said one face centered on and parallel to said center line.

13. The holder of claim 1 in which said portion of said outer surface of said at least one fastener is disposed away from said first face of said at least one slot by a distance slightly less than said distance between said working face of said at least one magnetic means and said portion of said wall farthest from said working face, whereby said working face of said at least one magnetic means extends into said at least one slot an amount in the range of 0.010 to 0.030 inches and in which said means for attaching said body to said mounting surface with said mounting face against said mounting surface comprises:

a first keyhole shaped T slot hole in said mounting face near said first end of said body, a second keyhole shaped T slot in said mounting face near said second end of said body, said keyhole shaped T slots each having a hole portion and a lengthwise dimension, said lengthwise dimensions being oriented perpendicular to said long dimension of said body, said first keyhole shaped T slot being a distance X from said second keyhole shaped T slot, said T slots having working surfaces a distance d from and being parallel to said mounting face, a first fastener having a head and an underside of said head, a second fastener, having a head and an underside of said head, whereby, with said first fastener inserted into said mounting surface with said underside of said head a distance slightly greater than said distance d from said mounting surface and said second fastener inserted into said mounting surface a distance X from said first fastener and with said underside of said head of said second fastener a distance slightly greater than said distance d from said mounting surface, said body is attached to said mounting surface by moving said hole portions of said keyhole shaped T slots over said first and second fasteners until said mounting face contacts said mounting surface and then moving said body parallel to said long dimensions of said T slots so that said undersides of said first and second fasteners engage said working surfaces of said first and second T slots and also in which said cavity extends through said body from said first end to said second end parallel to said long dimension and is open at said first end and said second end, and a first cap is attached to said first end to close off said cavity at said first end and a second cap is attached to said second end to close off said cavity at said second end.

14. The holder of claim 1 in which said portion of said outer surface of said at least one fastener is disposed away from said first face of said at least one slot by a distance slightly less than said distance between said working face of said at least one magnetic means and said portion of said wall farthest from said working face, whereby said working face of said at least one magnetic means extends into said at least one slot an amount in the range of 0.010 to 0.030 inches and in which said means for attaching said body to said mounting surface with said mounting face against said mounting surface comprises:

a first keyhole shaped T slot hole in said mounting face near said first end of said body, a second keyhole shaped T slot in said mounting face near said second end of said body, said keyhole shaped T slots each having a hole portion and a lengthwise dimension, said lengthwise dimensions being oriented perpendicular to said long dimension of said body, said first keyhole shaped T slot being a distance X from said second keyhole shaped T slot, said T slots having working surfaces a distance d from and being parallel to said mounting face, a first fastener having a head and an underside of said head, a second fastener, having a head and an underside of said head, whereby, with said first fastener inserted into said mounting surface with said underside of said head a distance slightly greater than said distance d from said mounting surface and said second fastener inserted into said mounting surface a distance X from said first fastener and with said underside of said head of said second fastener a distance slightly greater than said distance d from said mounting surface, said body is attached to said mounting surface by moving said hole portions of said keyhole shaped T slots over said first and second fasteners until said mounting face contacts said mounting surface and then moving said body parallel to said long dimensions of said T slots so that said undersides of said first and second fasteners engage said working surfaces of said first and second T slots and also in which said body has at least one first slot having width W1 and at least one second slot having width W2, said at least one first and at least one second slots each being oriented essentially perpendicular to said mounting face and said long dimension and having a first face, a second face and extending part way through said body toward said mounting face and intersecting said cavity, said width W1 being suitable for holding knives and the like and said width W2 being suitable for holding a knife sharpener and the like and, further, in which said cavity has a rectangular cross-section having one face closest to and essentially parallel to said mounting face, said one face having a longitudinal center line parallel to said long dimension of said body, said cavity further having a groove in said one face centered on and parallel to said center line.

15. The holder of claim 1 in which said portion of said outer surface of said at least one fastener is disposed away from said first face of said at least one slot by a distance slightly less than said distance between said working face of said at least one magnetic means and said portion of said wall farthest from said working face, whereby said working face of said at least one magnetic means extends into said at least one slot an amount in the range of 0.010 to 0.030 inches, and a which said means for attaching said body to said mounting surface with said mounting face against said mounting surface comprises:

a first keyhole shaped T slot hole in said mounting face near said first end of said body, a second keyhole shaped T slot in said mounting face near said second end of said body, said keyhole shaped T slots each having a hole portion and a lengthwise dimension, said lengthwise dimensions being oriented perpendicular to said long dimension of said body, said first keyhole shaped T slot being a distance X from said second keyhole shaped T slot, said T slots having working surfaces a distance d from and being parallel to said mounting face, a first fastener having a head and an underside of said head, a second fastener having a head and an underside of said head, whereby, with said first fastener inserted into said mounting surface with said underside of said head a distance slightly greater than said distance d from said mounting surface and said second fastener inserted into said mounting surface a distance X from said first fastener and with said underside of said head of said second fastener a distance slightly greater than said distance d from said mounting surface, said body is attached to said mounting surface by moving said hole portions of said keyhole shaped T slots over said first and second fasteners until said mounting face contacts said mounting surface and then moving said body parallel to said long dimensions of said T slots so that said undersides of said first and second fasteners engage said working surfaces of said first and second T slots and also in which said body has at least one first slot having width W1 and at least one second slot having width W2, said at least one first and at least one second slots each being oriented essentially perpendicular to said mounting face and said long dimension and having a first face, a second face and extending part way through said body toward said mounting face and intersecting said cavity, said width W1 being suitable for holding knives and the like and said width W2 being suitable for holding a knife sharpener and the like and, still further, in which said cavity extends through said body from said first end to said second end parallel to said long dimension and is open at said first end and said second end, and a first cap is attached to said first end to close off said cavity at said first end and a second cap is attached to said second end to close off said cavity at said second end.

16. The holder of claim 1 in which said portion of said outer surface of said at least one fastener is disposed away from said first face of said at least one slot by a distance slightly less than said distance between said working face of said at least one magnetic means and said portion of said wall farthest from said working face, whereby said working face of said at least one magnetic means extends into said at least one slot an amount in the range of 0.010 to 0.030 inches and in which said means for attaching said body to said mounting surface with said mounting face against said mounting surface comprises:

a first keyhole shaped T slot hole in said mounting face near said first end of said body, a second keyhole shaped T slot in said mounting face near said second end of said body, said keyhole shaped T slots each having a hole portion and a lengthwise dimension, said lengthwise dimension being oriented perpendicular to said long dimension of said body, said first keyhole shaped T slot being a distance X from said second keyhole shaped T slot, said T slots having working surfaces a distance d from and being parallel to said mounting face, a first fastener having a head and an underside of said head, a second fastener having a head and an underside of said head, whereby, with said first fastener inserted into said mounting surface with said underside of said head a distance slightly greater than said distance d from said mounting surface and said second fastener inserted into said mounting surface a distance X from said first fastener and with said underside of said head of said second fastener a distance slightly greater than said distance d from said mounting surface, said body is attached to said mounting surface by moving said hole portions of said keyhole shaped T slots over said first and second fasteners until said mounting face contacts said mounting surface and then moving said body parallel to said long dimensions of said T slots so that said undersides of said first and second fasteners engage said working surfaces of said first and second T slots and also in which said body has at least one first slot having width W1 and at least one second slot having width W2, said at least one first and at least one second slots each being oriented essentially perpendicular to said mounting face and said long dimension and having a first face, a second face and extending part way through said body toward said mounting face and intersecting said cavity, said width W1 being suitable for holding knives and the like and said width W2 being suitable for holding a knife sharpener and the like and, further, in which said cavity has a rectangular cross-section having one face closest to and essentially parallel to said mounting face, said one face having a longitudinal center line parallel to said long dimension of said body, said cavity further having a groove in said one face centered on and parallel to said center line and, still further, in which said cavity extends through said body from said first end to said second end parallel to said long dimension and is open at said first end and said second end, and a first cap is attached to said first end to close off said cavity at said first end and a second cap is attached to said second end to close off said cavity at said second end.

* * * * *